US006580220B1

(12) United States Patent
Yen

(10) Patent No.: US 6,580,220 B1
(45) Date of Patent: Jun. 17, 2003

(54) CIRCUIT DEVICE FOR SUSTAINING ILLUMINATION OF VEHICLE USED HIGH ILLUMINATION DISCHARGED LAMPS

(76) Inventor: Kuo-Pin Yen, 235 Chung-Ho Box, 8-24 Taipei (TW)

( * ) Notice: Subject to any disclaimer, the term of this patent is extended or adjusted under 35 U.S.C. 154(b) by 0 days.

(21) Appl. No.: 10/127,148

(22) Filed: Apr. 22, 2002

(51) Int. Cl.[7] ..... H05B 37/00
(52) U.S. Cl. ..... 315/82; 315/83; 307/10.8
(58) Field of Search ..... 315/78, 79, 80, 315/82, 83, 219, 307; 307/10.8

(56) References Cited

U.S. PATENT DOCUMENTS 4,841,198 A * 6/1989 Wilhelm ..... 315/82

* cited by examiner

*Primary Examiner*—David Vu

(57) ABSTRACT

A circuit device for sustaining the illumination of a vehicle used high illumination discharged (HID) lamps is disclosed. The circuit device comprises: a high/low beam switching delay circuit, and an HID lamp set power supply circuit. The high/low beam lamp switching delay circuit includes a lamp switch; a polarity correction circuit; a time delay circuit; and an isolation circuit. The HID lamp set power supply circuit includes an isolation circuit; a large current conduction circuit; a battery; an HID lamp circuit. By above mentioned circuit device, when the lamp switch switches between high/low beam lamps of a vehicle, the low lamp beam is sustained to light up continuously, thereby, the lifetimes of the electronic ballasts and HIV lamp are prolonged.

1 Claim, 2 Drawing Sheets

CIRCUIT DEVICE FOR SUSTAINING ILLUMINATION OF VEHICLE USED HIGH ILLUMINATION DISCHARGED LAMPS

FIELD OF THE INVENTION

The present invention relates to circuit device for switching the high/low beam lamp; and particularly to circuit device for sustaining the illumination of a vehicle used high illumination discharged (HID) lamps.

BACKGROUND OF THE INVENTION

The prior art head light has a bulb having two tungsten silks. The tungsten silks can be used to emit a high beam and a low beam, respectively. However, with the advance of technology, some novel light source has been developed, such as high illumination discharged (HID) lamp tube which is used to replace the conventional tungsten bulb. The HID lamp has an illumination better than the current used tungsten bulb and is a single light source. Therefore, the HID lamp can not have two light sources in one lamp tube. As it is used as a vehicle lamp as a head lamp. Two HID lamps are necessary, one as a high beam light and the other as a low beam light. However, this will increase the cost, and moreover, for prior vehicle installed with two light source bulb, the HID lamps can not be used since this kind of prior art vehicle has only one lamp seat.

Moreover, the prior art tungsten lamps is controlled by two ways of positive polarity and negative polarity. Since three terminals of the tungsten lamps are isolated from one another, and thus no problem of the continuity of positive polarity and negative polarity. As HID lamps are used as head lamps of a vehicle, the control way of positive polarity and negative polarity must be overcome since the HID lamps are driven by electronic ballasts. In switching the polarities, the current flowing to the electronic ballasts will interrupt so as to induce a flash effect of the electronic ballast. This will reduce the lifetime of the electronic ballasts and the HID lamps.

SUMMARY OF THE INVENTION

Accordingly, the primary object of the present invention is to provide a circuit device for sustaining the illumination of a vehicle used high illumination discharged (HID) lamp so as to prolong the lifetime of the electronic ballasts and HID lamps.

To achieve above mentioned object, the present invention provides a circuit device for sustaining the illumination of a vehicle used high illumination discharged (HID) lamp. The circuit device comprises: a high/low beam switching-delay circuit, and an HID lamp set power supply circuit. The high/low beam lamp switching delay circuit includes a lamp switch for switching the high/low beam lamps of a vehicle; a polarity correction circuit for inducing current of correct positive or negative polarities to flow to the time delay circuit; a time delay circuit having a capacitor for storing charges of the current from the polarity correction circuit; an isolation circuit having an optical coupler. The HID lamp set power supply circuit includes an isolation circuit having a signal receiving end for receiving signal coupled from the optical coupler; a large current conduction circuit having a relay for controlling the operations of an electronic ballast and a low beam lamp; a battery; an HID lamp circuit serves for actuating the electronic ballasts at two lateral sides of said vehicle and an HID lamp.

By above mentioned circuit device, when the lamp switch switches between high/low beam lamps of a vehicle, the low lamp beam is sustained to light up continuously, thereby, the lifetimes of the electronic ballasts and HIV lamp are prolonged.

The various objects and advantages of the present invention will be more readily understood from the following detailed description when read in conjunction with the appended drawing.

DETAILED DESCRIPTION OF THE PREFERRED EMBODIMENTS

Figure 1:
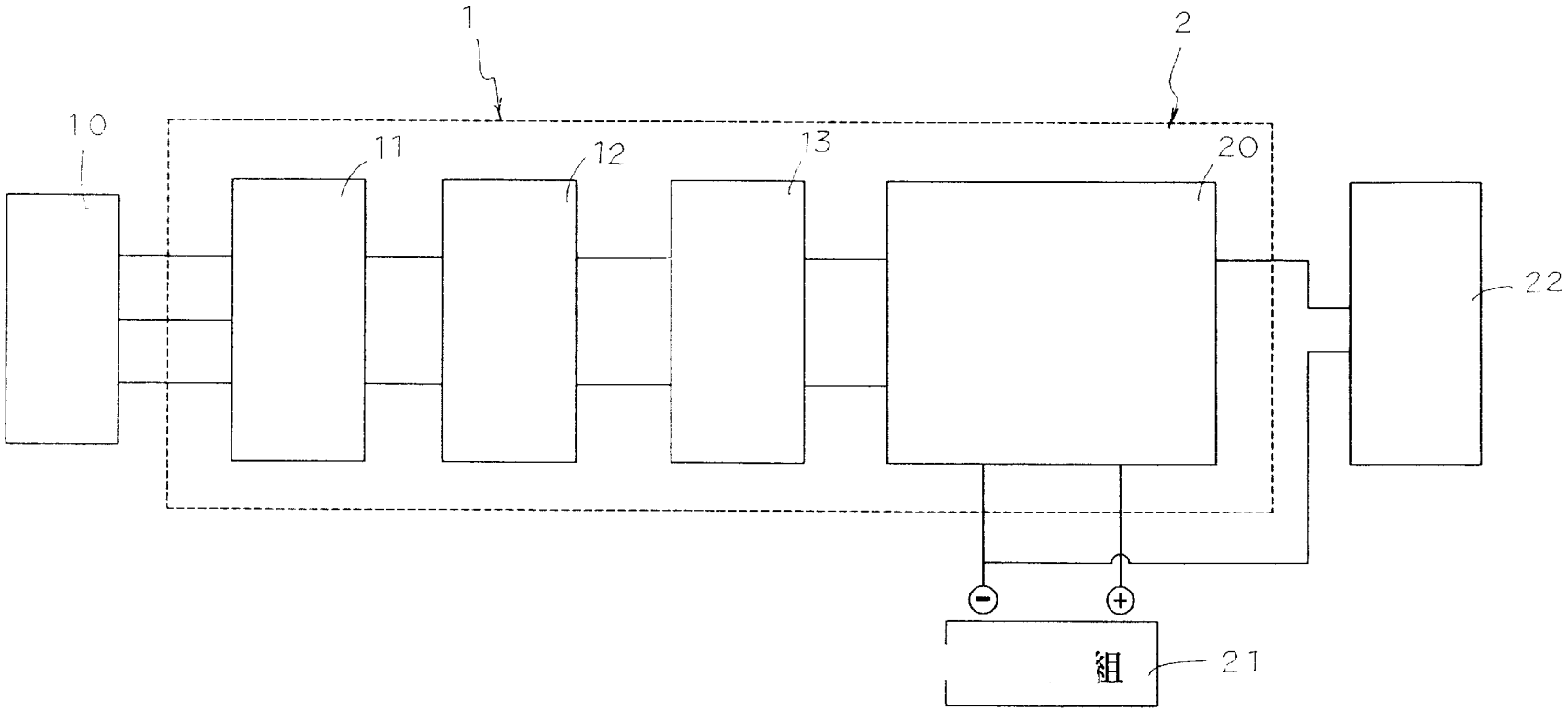
FIG. 1 is block diagram illustrating the structure of the present. invention

Referring to the appended drawings, the circuit structure of the vehicle used HID (High Illumination Discharge) lamp of the present invention is illustrated. As illustrated in the drawings, the circuit includes a high/low beam lamp switching delay circuit 1, and an HID lamp set power supply circuit 2.

The high/low beam lamp switching delay circuit 1 has the following components.

A lamp switch S1 (10) serves for switching the high/low beam lamps of a vehicle.

A polarity correction circuit 11 is formed by six diode D1 to D6 and two resistors R1 and R2. The polarity correction circuit 11 has rectifying effect and serves for assuring no fault to occur. Thereby, a current with correct positive and negative polarities flows to the time delay circuit 12.

A time delay circuit 12 includes a capacitor 12 for storing the current and then the power is supplied to the isolation circuit 13.

The isolation circuit 13 has an optical coupler PH and includes a signal emitter PH1 for coupling the current to the HID lamp set power supply circuit 2.

The HID lamp set power supply circuit 2 has the following components.

The isolation circuit 13 has a signal receiving end PH2 receiving signal emitted from the optical coupler PH so as to receive the lamp induction signal emitted from the PH1 to present a coupling effect. A transistor TR1 is used as a lamp sensitive switch for driving a large current conduction circuit 20 when signals are received.

A large current conduction circuit 20 has a relay RE. The function of the large current conduction circuit 20 for controlling the operations of an electronic ballast BAL and a low beam lamp L. When the relay RE is triggered by the transistor TR1 so that S1 will contact and conduct the S2. Then current from the battery BAT flows to the electron ballast BAL and the low beam lamp L. Thus the low beam lamp still lights up. A diode D8 serves for retaining the polarities for protecting the lamp coupler PH.

A battery 21 is a vehicle used battery BAT for actuating a car circuit and the power source used by the high and low beam lamps. A fuse F serves for protecting circuit.

The HID lamp circuit 22 serves for actuating the electronic ballasts at the right and left front sides of a car and an HID lamp.

The operation of the present invention will be described in the following.

Figure 2:
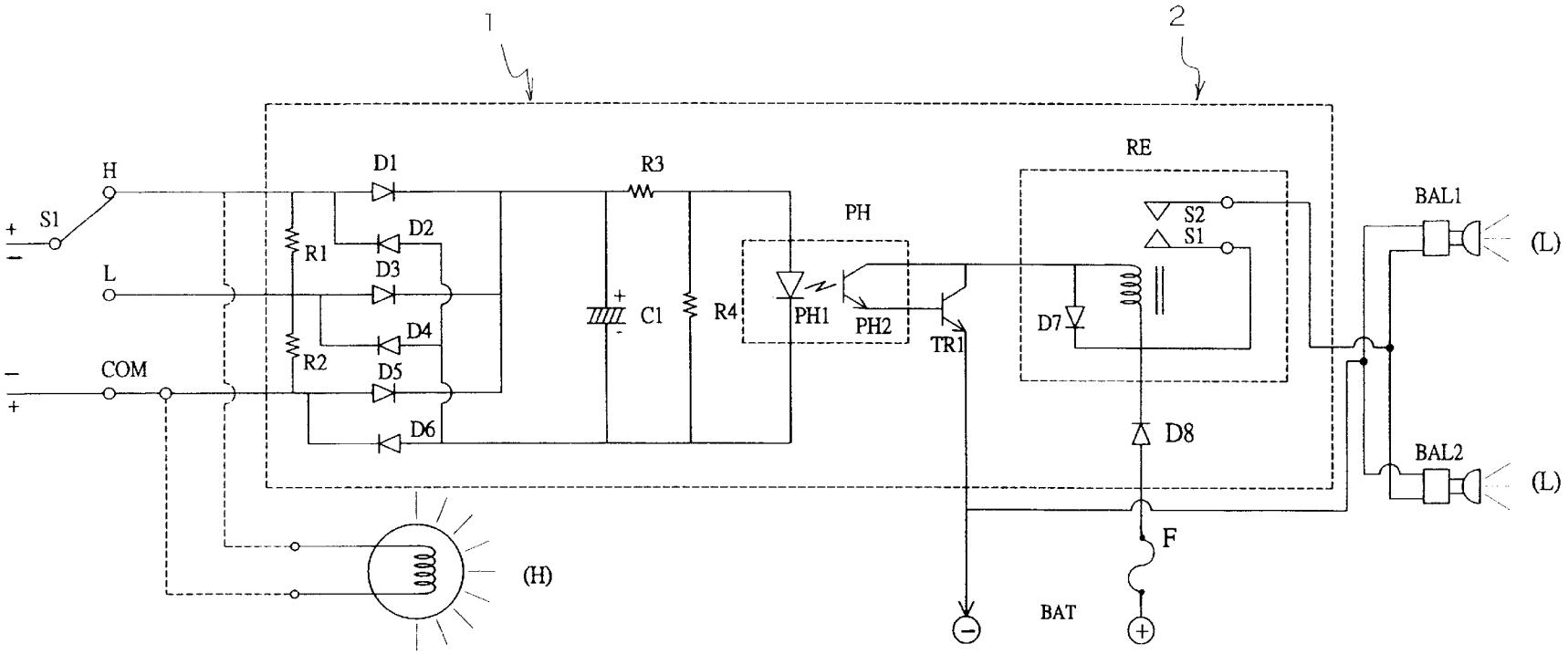
FIG. 2 is a circuit diagram of the present invention.

By the circuit structure of above mentioned HID lamp, when it is installed to a car and the lamp switch 10 is switched to H (referring to FIG. 2), the circuit with diodes D1 and D2 is conducted so that a current will charge the capacitor C1. Then current further flows through the resistors R3 and R4. Then current flows to the optic coupler PH of the isolation circuit 13 so that the signal emitting end PH1 can emit lamp continuously. However, when the signal receiving end PH2 of the optical coupler PH in the isolation circuit 13 receives the signal from PH1. The transistor will be actuated and then the large current conduction circuit 20 will be conducted. As a result, the two joints S1, S2 of the relay RE will conduct. Since the joint S2 is conducted, the current from the battery set 21 can actuate the electronic ballasts and the lower beam lamp so as to lower beam lamp L to light up continuously, while the illumination of the high beam lamp H is controlled by the switch 10.

Due to the circuit structure of the present invention, the current stored in the capacitor C1 is larger than the current required in the period of the switching of the high beam lamp and low beam lamp by the switch S1 (10). Thereby, in the switching period (from low beam lamp to high beam lamp, or from high beam lamp to low beam lamp), the HID lamps of the low beam always lights up. Therefore, the flash of the HID lamp owing to the switching between high and low beam lamps can be avoided. Namely, the lifetime of electronic ballasts and the HID lamp can be prolonged.

Moreover, the circuit structure of a vehicle used HID lamp is only suitable for the cars with two inner low beams and two outer high beam lamps and but also suitable for the vehicles with two front lamps (one at the right side and one at the left side). The prior art lamps can be used with the present invention without being updated the old ones.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A circuit device for sustaining the illumination of a vehicle used high illumination discharged (HID) lamps comprising: a high/low beam switching delay circuit, and an HID lamp set power supply circuit; wherein the high/low beam lamp switching delay circuit includes;

a lamp switch for switching high/low beam lamps of a vehicle;

a polarity correction circuit having diodes and resistors which forms a rectifier circuit for rectifying current flowing therethrough so that a current having correct positive and negative polarities to flow to a time delay circuit;

the time delay circuit having a capacitor for storing charges of the current from the polarity correction circuit;

an isolation circuit having an optical coupler; the optical coupler includes a signal emitter for coupling the current to the HID lamp set power supply circuit;

the HID lamp set power supply circuit including:

a signal receiving end of the isolation circuit for receiving signal coupled from the optical coupler so as to receive signals emitted from the isolation circuit; a transistor being used as a lamp sensitive switch;

a large current conduction circuit, the large current conduction current being driven by the transistor when signal is received, and the large current conduction circuit having a relay for controlling the operations of an electronic ballast and a low beam lamp; when the relay being triggered by the transistor so that two joints of the relay will contact one another; then current from a battery flowing to the electronic ballast and the low beam lamp; thus the low beam lamp still lights up;

the battery for actuating the HID lamp circuit and a power source used by the high and low beam lamps;

the HID lamp circuit serving for actuating the electronic ballasts at two lateral sides of said vehicle and HID lamps;

wherein by above mentioned circuit device, when the lamp switch switches between high/low beam lamps of a vehicle, the low beam lamp is sustained to light up continuously, thereby, the lifetimes of the electronic ballasts and HID lamp are prolonged.

* * * * *